US009121121B2

(12) United States Patent
Pan

(10) Patent No.: US 9,121,121 B2
(45) Date of Patent: Sep. 1, 2015

(54) METHOD FOR DRIVING CLOTHES TO ROLL IN UPRIGHT BARREL BY USING IMPELLERS AND APPLICATION THEREOF

(75) Inventor: Xuezhen Pan, Shanghai (CN)

(73) Assignee: HEFEI GOOLU TECH. WASHER CO., LTD., Hefei, Anhui Province (CN)

( * ) Notice: Subject to any disclaimer, the term of this patent is extended or adjusted under 35 U.S.C. 154(b) by 385 days.

(21) Appl. No.: 13/704,880

(22) PCT Filed: Nov. 30, 2010

(86) PCT No.: PCT/CN2010/001923

§ 371 (c)(1),
(2), (4) Date: Dec. 17, 2012

(87) PCT Pub. No.: WO2011/156944

PCT Pub. Date: Dec. 22, 2011

(65) Prior Publication Data

US 2013/0091636 A1 Apr. 18, 2013

(30) Foreign Application Priority Data

Jun. 11, 2010 (CN) ..... 2010 1 0198042

(51) Int. Cl.
*D06F 17/10* (2006.01)
*D06F 37/40* (2006.01)
(Continued)

(52) U.S. Cl.
CPC ..... *D06F 17/10* (2013.01); *D06F 13/02* (2013.01); *D06F 17/06* (2013.01); *D06F 17/08* (2013.01); *D06F 21/06* (2013.01); *D06F 21/08* (2013.01); *D06F 35/006* (2013.01); *D06F 37/145* (2013.01); *D06F 37/40* (2013.01)

(58) Field of Classification Search
CPC ..... D06F 17/06; D06F 17/10; D06F 37/145; D06F 37/40
USPC ..... 8/137, 158, 159; 68/133, 134
See application file for complete search history.

(56) References Cited

U.S. PATENT DOCUMENTS 5,829,277 A 11/1998 Wunderlich
5,850,750 A 12/1998 Cho
(Continued)

FOREIGN PATENT DOCUMENTS

CN 1721610 1/2006
CN 2778852 5/2006
(Continued)

OTHER PUBLICATIONS

Machine translation of CN 101718030 to PAN, no. date.*

*Primary Examiner* — Joseph L Perrin
(74) *Attorney, Agent, or Firm* — Muncy, Geissler, Olds & Lowe, P.C.

(57) ABSTRACT

A method for driving laundry to roll in an upright tub with a pulsator and uses of the same are disclosed. The method makes laundry alternately but not simultaneously form at least two rolling faces in the upright tub. The rolling faces have a certain angle therebetween, laundry is performed more than one rolling on one of the rolling faces and then switched to another rolling face to be performed more than one rolling on the other rolling face. There is at least one pulsator to provide a side auxiliary force during rolling processes. The number of the pulsators driving laundry is preferably 3~5, the number of rib on the pulsator is preferably 3~8. The method can significantly improve cleaning performance and provide the advantage of multi-direction rolling.

9 Claims, 4 Drawing Sheets

(51) Int. Cl.

| | |
|---|---|
| ***D06F 37/14*** | (2006.01) |
| ***D06F 13/02*** | (2006.01) |
| ***D06F 17/06*** | (2006.01) |
| ***D06F 21/06*** | (2006.01) |
| ***D06F 17/08*** | (2006.01) |
| ***D06F 21/08*** | (2006.01) |
| ***D06F 35/00*** | (2006.01) |

(56) References Cited

U.S. PATENT DOCUMENTS

| | | | | |
|---|---|---|---|---|
| 5,950,460 | A | 9/1999 | Oh | |
| 6,220,063 | B1 | 4/2001 | Wunderlich et al. | |
| 7,039,976 | B2 * | 5/2006 | Sears | 8/159 |
| 2004/0168261 | A1 | 9/2004 | Griffith et al. | |

FOREIGN PATENT DOCUMENTS

| | | | |
|---|---|---|---|
| CN | 200520133107 | | 2/2007 |
| CN | 101191285 | | 6/2008 |
| CN | 101191286 | | 6/2008 |
| CN | 201176525 | | 1/2009 |
| CN | 200510080134 | | 10/2009 |
| CN | 101718030 | | 6/2010 |
| CN | 101880946 | | 11/2010 |
| CN | 101906705 | | 12/2010 |
| CN | 101906708 | | 12/2010 |
| CN | 102277705 | A | 12/2011 |
| FR | 1131586 | | 2/1957 |

* cited by examiner

METHOD FOR DRIVING CLOTHES TO ROLL IN UPRIGHT BARREL BY USING IMPELLERS AND APPLICATION THEREOF

CROSS-REFERENCE TO RELATED APPLICATIONS

This application is a National Phase Entry of PCT International Application NO. PCT/CN2010/001923, which was filed Nov. 30, 2010, and claims priority to Patent Application No. 201010198042.2 filed in P.R. China on Jun. 16, 2010, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the present invention described herein. All references listed, cited and/or discussed in this specification are incorporated herein by reference in their entireties and to the same extent as if each reference was individually incorporated by reference.

FIELD OF THE PRESENT INVENTION

The present invention relates to a method for directly rolling laundry in an upright tub with a pulsator, and specifically, the present invention relates to a method for driving laundry to alternately roll on at least two rolling faces having a certain angle therebetween in an upright tub with a plurality of rotary pulsators and uses of the same in a laundry dryer and a washing machine.

BACKGROUND OF THE PRESENT INVENTION

In the prior art, a washing machine is generally classified as a drum washing machine, a pulsator washing machine, and an agitator washing machine.

The pulsator washing machine agitates the water stream by means of a pulsator and then water stream moving randomly agitates laundry, so as to complete a washing process and a rinsing process of laundry.

The agitator washing machine drags laundry to move in water directly or indirectly by virtue of a force of water by means of an agitating upright pole, so as to complete washing of laundry.

In principle, the pulsator washing machine and the agitator washing machine are quite similar.

In development of the pulsator washing machine, a technical solution using a plurality of pulsators is disclosed in many documents, examples of which are as follows.

Disclosed is a washing machine having a plurality of pulsators in FR1131586. The plurality of pulsators may be horizontally or obliquely provided at a bottom of a washing tub, which may rotate in the same direction or in different directions.

Disclosed is a top loading type washing machine having a spherical washing basket in U.S. Pat. No. 5,829,277 A. The side agitators having the shape of a spherical segment are mounted on the washing basket, the two agitators rotate only in the same clockwise direction or the same counter-clockwise direction (as viewed from facing the agitators) due to the limitation on the transmission thereof.

Disclosed is a washing machine having a pulsator device in CN1170056. The pulsator device comprises: a driving pulsator mounted on a bottom of a drum and driven by a motor to rotate and a plurality of driven pulsators rotating around respective axes of support shafts fixed on a side wall of the drum under driving of the driving pulsator.

Disclosed is an agitator of a washing machine in CN1200416, the washing machine has a washing tub, and at least two oblique portions protrude inwardly on a bottom of the washing tub. A washing shaft on which extends upwardly from the bottom of the washing tub and is rotatable. A driving wheel is mounted on the washing shaft, and on a side face of which a frictional plane is formed. There are at least two frictional wheels which are rotatable and contact the frictional plane of the driving wheel. There are at least two driven wheels, frictional planes on a side of which contacts the frictional wheels respectively, wherein the driven wheel is rotatably mounted on one plane of the oblique portions. At least two agitating blades are mounted on the other plane of the oblique portions.

Disclosed is a transmission apparatus of a speed reducing clutch of a washing machine in CN2778852, which comprises an upper case cover, a lower case cover above which the upper box cover is fixed, an output shaft, a pulsator shaft, a dewatering shaft further connected with the lower case cover, a driving gear, a driven gear, and a speed reducer transmission system with which the pulsator shaft and the dewatering shaft are connected. The driving gear and the driven gear are sheathed respectively at a periphery of the pulsator shaft and at a periphery of the output shaft, and the driving gear and the driven gear are engaged. An upper end and a lower end of the output shaft are mounted respectively to the upper box cover and the lower case cover.

Fundamental objects of the above technical solutions using a plurality of pulsators in the prior art are to realize complex a water stream so as to reduce wrapping of washed laundry and improve the cleaning rate of the washed laundry. Their objects and the technical solutions are not intended to realize a rolling effect in an upright tub type washing machine similar to that in the drum washing machine.

The drum washing machine lifts laundry by means of a plurality of ribs fixed to an inner wall of an inner tub so as to repeatedly lift laundry and make laundry fall in the inner tub so as to complete a washing process and a rinsing process.

It was considered in the prior art that the agitator washing machine and the pulsator washing machine have higher cleaning rates, shorter washing times, and are relatively easy to control balance during spin-drying at a high speed. However, such kinds of washing machines have higher wear and tear, higher water consumption amount and relatively serious wrapping of laundry.

The drum washing machine has a lower cleaning rate, lower wear and tear, lower water consumption amount, and less serious wrapping of laundry. However, it requires longer washing time and is relatively more difficult to control balance during spin-drying at a high speed.

The people skilled in the art have researched for decades and have not attained an effective means until now on how to combine advantages of and simultaneously remove deficiencies of the above different washing machines.

US MAYTAG Company proposes a beneficial concept which is specifically as follows. U.S. Pat. No. 6,220,063 B1 discloses a washing machine, two agitators in this document rotate respectively in a clockwise direction and an counter-clockwise direction, and when they are provided as shown in the drawings, they form lifting and falling effects similar to those in the drum washing machine.

The technical solutions disclosed in this document certainly present a concept that the rolling action is realized by pulsators in an upright tub washing machine.

However, this solution also has many deficiencies. For example, it requires the pulsator to be very large and to have a close match at an engaging point between the pulsator and the inner tub so as to prevent laundry from being clamped. Furthermore, regardless of a distance between lower ends of the two pulsators, it is quite difficult for a small amount of laundry to form a lifting and a falling process. Moreover, for a practical product of this solution, laundry often forms a "Rugby ball" shape during the washing process. So that laundry inside and laundry outside can not be exchanged and thus washing uniformity is lowered.

This document is incorporated into the present invention as a main document in the background field. And the present invention omits some description on the prior art. Corresponding contents disclosed in this document may be directly referenced and will not be described in details in the present invention.

CN1721610 discloses a suspension-type dual-pulsator washing machine and declares that it has the following features: a rolling effect as the drum washing without wrapping, has lower wear and tear, simultaneously has advantages of a high cleaning rate and saving water consumption as the pulsator washing, and has washing processes which may be performed as long as the highest water level reaches to ¼~½ height of the pulsator. However, because it does not disclose a size of the pulsator, an angle providing the pulsators and an inner diameter of a tub, the initial water amount is not a determined value.

Maytag possesses the 2 above said patents which are similar to that disclosed in CN200520133107.X and CN2005100801 34.X. It has quite a lower probability to exchange and arbitrary exchange laundry inside and laundry outside in a laundry ball, thereby causing differences in washing uniformity of laundry.

A previous patent application, i.e. CN101191285A (2008 Jun. 4), of the applicant of the present invention discloses a vertical multi-pulsator washing machine. That has are three or four pulsators pivotally correspondingly provided at 120 degrees or 90 degrees around an inner wall of an inner tub. Washing processes may be performed as long as incoming water amount reaches to a ⅓ height of the pulsators. All the pulsators may rotate simultaneously clockwise or counter-clockwise to wash laundry. This application is an improvement on the pulsator washing machine with a principle in the prior art, since the pulsators rotate "simultaneously clockwise or counter-clockwise". It can not attain a rolling mode having two rolling faces as described in the present invention. Moreover, because diameters of the pulsators, parameters of an inner tub, and the like are not determined, the rated incoming water amount is not a determined value.

A previous patent application, CN101191286 A (2008 Jun. 4, JULONG company), of the present invention discloses a multi-pulsator washing machine. Which have are three or four pulsators. During washing cycles, the three or four pulsators rotate in the same direction or in different directions in an inner tub. According to the two embodiments disclosed, similarly, it is not possible to attain the effect of the present invention, and it rolls, agitates, impacts, compresses, tapes, or rubes laundry by means of water stream.

A previous patent application, CN201176525A, of the applicant of the present invention, discloses a full-automatic multi-pulsator washing machine which mainly is an improvement on a driving mode of the prior art.

All the prior arts and practical products thereof, in addition to the complex structure of the pulsator, high cost, and large noise, the most serious deficiency lies in that laundry repeatedly rolls at most on one assumed plane when a mode using two pulsators are obliquely provided. Similar to the drum washing machine in the prior art, it can not realize to make laundry roll in more than one direction. Also, when an amount of laundry is small, it is quite difficult to realize rolling, and it is easy to form a "Rugby shape" when laundry rolls in one direction.

SUMMARY OF THE PRESENT INVENTION

In view of the above, the present invention is proposed.

In order to precisely define technical solutions of the present invention, the following terms are specially self-defined in the present invention and are as the criterion of definitions of the present invention, regardless whether there are similar definitions in the prior art.

In the present invention, clockwise rotation and counter-clockwise rotation of a pulsator refers to and only refers to rotational directions when a viewer faces a front face of the pulsator (a rear face of the pulsator is a face adjacent to a surface of an inner tub or a washing tub).

Laundry stream 24 refers to a flowing body of laundry formed by a stack of washed laundry basically moving in a direction similar to continuous rolling.

A rolling face refers to an assumed plane for movement of laundry in the present invention, referring to FIG. 5. Laundry is driven on one imaginary plane by two rotary pulsators adjacent and obliquely provided (as viewed from facing the two pulsators, the pulsator on the left rotates counter-clockwise; the pulsator on the right rotates clockwise). Thus laundry is gathered and lifted and then projected in a direction toward the center of an upright tub, and then scatters and falls, as shown in FIG. 4*a*, FIG. 4*b* and FIG. 5. Assuming there is one assumed plane 21 between the pulsators 6,8 (or the pulsators 7,8). Laundry stream 24 moves on the assumed plane 21. Certainly, the movement process of driven laundry would not be on a "flat" plane as a physical or spatial conception. "The assumed plane 21" introduced herein is only for clear description of the present invention, and the practical movement process of laundry may be clearly understood from the description and the drawings of the present invention. Simultaneously, the same two pulsators adjacent and obliquely provided, when rotating conversely, would not drive laundry to form the same process of being gathered, being lifted, and then being projected in a direction toward the center of the upright tub, and then scattering and falling.

A main objective of the present invention is to provide a method for driving laundry to roll with pulsators, and specifically speaking, the method makes laundry alternately move on at least two rolling faces having a certain angle therebetween and has another pulsator providing a side auxiliary force.

Another object of the present invention is for the use of the method in a washing machine or a laundry dryer.

The objects of the present invention may be realized by the following manner.

A full-automatic washing machine of the present invention comprises an inner tub and an outer tub. The outer tub is suspended on a metal bracket of the outer casing of the washing machine by a suspension pole. The inner tub is rotatably fixed within the outer tub by a transmission mechanism, at the same time, the pulsators are rotatably fixed within the inner tub.

A method for driving laundry to roll with the pulsators of the present invention, when applied in the washing machine, comprises washing, rinsing, and spin-drying. During washing or rinsing the following will occur: putting into and/or not putting into a detergent or other detergent auxiliary, and feeding water to a prescribed level, initiating a motor to drive the pulsators to rotate, driving laundry and lifting laundry in a manner of a similar continuous laundry stream. This is accomplished by the lifting ribs on one pair of the adjacent rotary pulsators, projecting laundry and having laundry scatter and fall due to inertia and gravity, and then performing lifting again. This process is repeated at least one time. Additionally driving and lifting laundry in a manner of a similar continuous laundry stream by the lifting ribs on another pair of adjacent rotary pulsators, projecting laundry and having laundry scatter and fall due to inertia and gravity; and then performing lifting again, also repeating this process at least one time. The assumed planes of the two laundry streams have an angle of 20~160 degrees, preferably an angle of 80~140 degrees. Furthermore, one of the processes of washing laundry is a circulation process of driving, lifting and gathering laundry by the lifting ribs of a pair of adjacent rotary pulsators and projecting washed laundry and having washed laundry scatter and fall due to inertia and gravity and then performing lifting again. This circulation process is repeated at least 3~50 times, but preferably 5~30 times.

In the present invention it is preferred that one or another pair of pulsators shares one of the pulsators. Rotation directions of adjacent edges of the pair of adjacent rotary pulsators are opposite and upward so that the lifting ribs on the pulsators lift washed laundry, as viewed from facing the pair of pulsators. Then the pulsator close to the left rotates in a counter-clockwise direction, and the pulsator close to the right rotates in clockwise direction.

The pulsators of the present invention is rotatably provided between the center of the inner tub and a side wall of the inner tub. The pulsators comprise a basic face and a rib provided on the basic face. The thickness of the rib at a maximum thickness position is 10~90%, preferably 25~65%, of the same of the whole pulsator at a maximum thickness position of the whole pulsator. The basic face is a plane plate shape or a curve shape, parts of the basic face and the inner tub which contact each other are matched in shape. The pulsator of the present invention is obliquely provided in the inner tub as high at a position close to the side wall of the inner tub and low at a position close to the center of the inner tub. An axis of a central driving shaft of the pulsator is intersected with a central axis of the inner tub. An acute angle part of an angle between the two axes is greater than 0 degree and less than 90 degrees; preferably greater than 10 degrees and less than 60 degrees but more preferably, greater than 35 degrees and less than 45 degrees. And the most preferred is greater than 38 degrees and less than 42 degrees. The rotation speed of the pulsator is 15~65 RPM, preferably 30~55 RPM. The lifting ribs are provided on the pulsator from a position near a center of the pulsator to a position near an edge of the pulsator. The number of the lifting ribs is 1~8, but preferably 4~6.

In the present invention, there is at least another rotary pulsator for providing a side driving force to laundry outside a pair of adjacent rotary pulsators for lifting laundry and projecting laundry and having laundry scatter and fall due to inertia and gravity.

The method for washing laundry of the present invention at least has two rolling faces for laundry which are alternately but not simultaneously formed and have a certain angle therebetween so as to provide a rolling mechanical force to laundry for washing or drying. The rolling faces are formed by rotation of the pulsators and driving laundry. One of the rolling faces for laundry is formed by the two pulsators which are adjacent and obliquely provided. There is at least one pulsator for providing a side auxiliary force and another rolling face for laundry is alternately and non-simultaneously formed by another group of two pulsators which are adjacent and obliquely provided. There further is at least one pulsator for providing a side auxiliary force. Any one of the rolling faces is formed by rotations of the two adjacent pulsators. And in the two groups of the pulsators which form the two rolling faces, one of these pulsators may be shared or may not be shared.

Washing manner having two rolling faces is preferable. Certainly, the present invention also provides a technical solution having a plurality of rolling faces. An angle between the assumed planes formed by the two rolling faces is 0~120°, preferably 90~120°, more preferably 120°. During washing, laundry will roll more than one time on any one of the rolling faces, and then switch onto another rolling face and roll more than one time, this process is repeatedly circulated until the end of the washing cycle. The number of rolling of washed laundry on the different rolling faces may be or may not be the same.

The number of ribs provided on the pulsator from the center to the edge as required may be one, may be 1~8, but preferably is 4~6. The washing manner may be realized by 3~6 pulsators, preferably 3~4 pulsators, but most preferably 3 pulsators. Rotation speeds of the pulsator for rolling or providing the side auxiliary force is 10~90 RPM, preferably 30~45 RPM.

A previous patent application, CN101718030A (2010 Jun. 2), of the applicant of the present invention discloses a transmission mechanism of a full-automatic multi-pulsator washing machine and a washing machine and a washing manner thereof, which relates to a technology of washing machines. When there is at least one pulsator rotating in the opposite direction of the other pulsators the laundry can be projected upwardly in a relative large extent, will roll in a vertical plane, and rotates in a horizontal plane simultaneously, and changes into different projected phases, so that laundry would not be mutually wrapped. As described previously, this patent application takes into account effects of angles between rolling faces of pulsators and the number of pulsators. But it does not consider that the amount of water, the number of ribs, and the rotation speed may cause the number of rolling of laundry to be obviously changed. But the number of the rolling of laundry changes non-linearly with these factors. This document is referenced into the present invention as background technology.

The method for rolling laundry in a pulsator-type rolling-mode of the present invention is as lifting and gathering laundry by means of the lifting ribs on the pulsators and projecting laundry and having it scatter and fall and then performing on lifting again. Then changing to another angle to repeat the above process. The method may perform washing or rinsing similar to the drum washing machine or even at lower water levels, at the same time perform washing laundry in more than one rolling face direction, and avoid a deficiency that washed laundry can not be exchanged between the outside and the inside. Additionally, using the upright tub manner, the difficulty of provision of balance is reduced. The method overcomes deficiencies of the drum and the pulsator washing machines and combines their advantages and even having more advantages than a simple combination of them.

BRIEF DESCRIPTION OF THE DRAWINGS

The following is the description of the drawings of the present invention and how it can be further understood by these descriptions in which.

Figure 1:
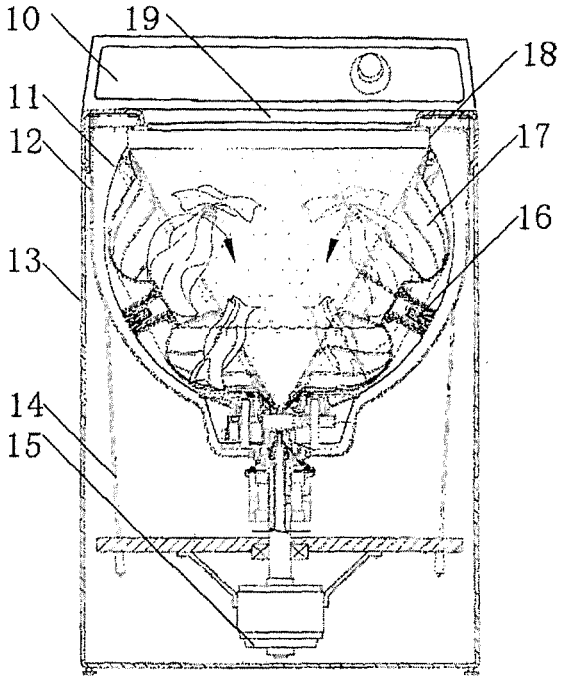
FIG. 1 and FIG. 2 are schematic diagrams illustrating a structure and a pulsator driving of a washing machine disclosed in U.S. Pat. No. 6,220,063B1.
Figure 2:
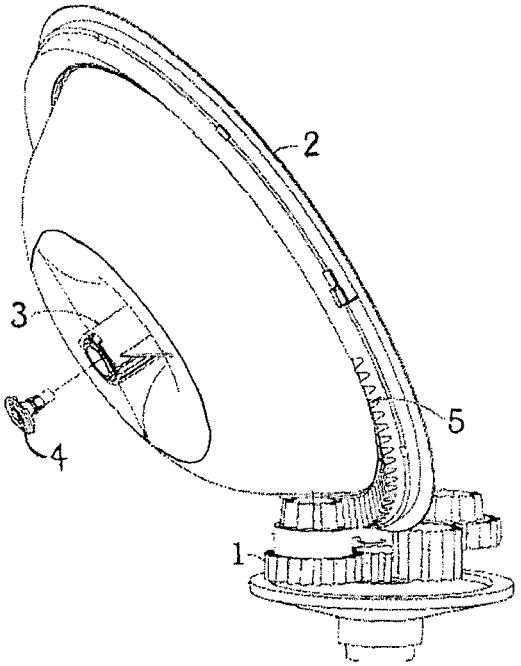
Figure 3:
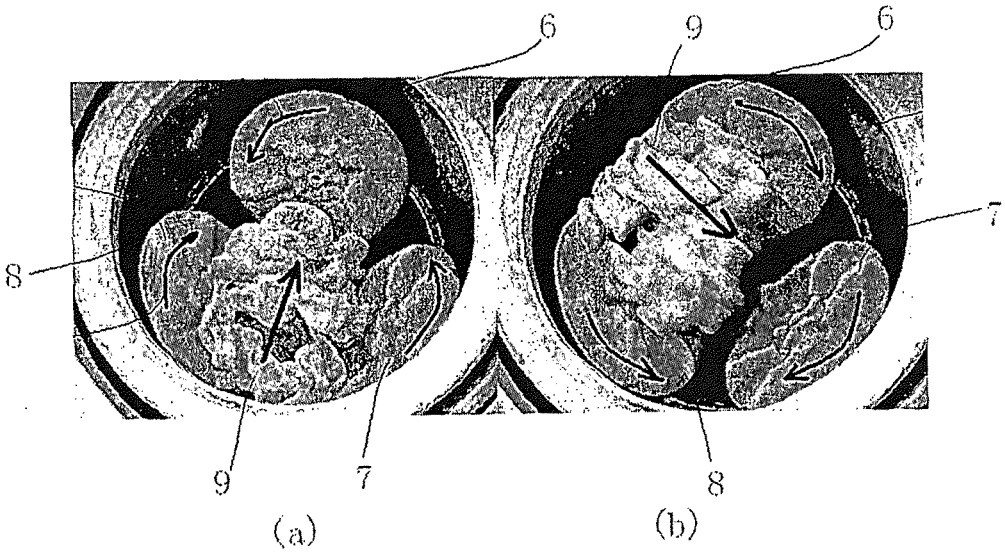
FIG. 3 photos illustrates the operating process of a demo manufactured according to the description of the present invention, in which (a) and (b) are schematic diagrams respectively illustrating that washed laundry forms rolling between different pairs of pulsators.
Figure 4:
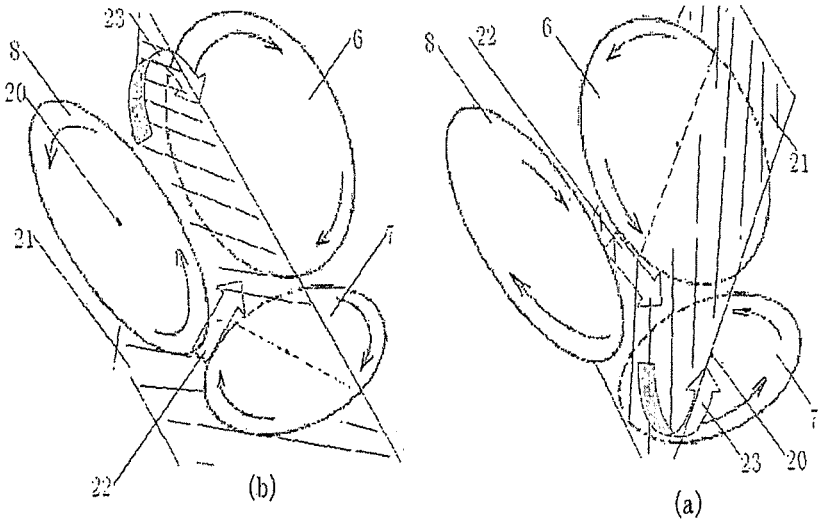
FIG. 4 is a schematic diagram illustrating the principle of the embodiment of FIG. 3, in which (a) and (b) are schematic diagrams respectively illustrating that washed laundry forms rolling between different pairs of pulsators.
Figure 5:
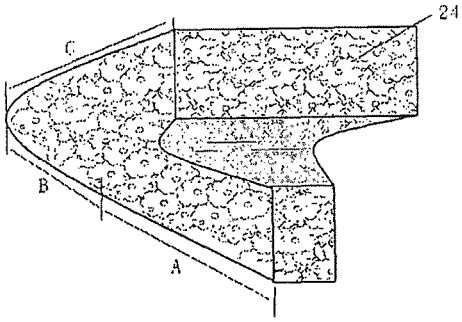
FIG. 5 is a schematic diagram illustrating a process of being gathered, lifted, projected, scattering, and falling of washed laundry.

In order to clearly understand the present invention, names and reference numerals of individual elements are given as follows.

1 Gear train
2 Pulsator
3 pulsator shaft sleeve
4 Pulsator fastener
5 Geared ring
6, 7, 8 pulsators
9 Rolling direction
10 Control panel
11 Inner tub
12 Outer tub
13 Cabinet
14 Damping suspension rod
15 Motor
16 Pulsator rotatable connecting element
17 Pulsator
18 Inner ring
19 Feeding port movable case cover
20 Pulsator shaft
21 Assumed plane
22 Washed laundry side auxiliary transmission direction
23 Schematic diagram for rolling of washed laundry
24 Washed laundry stream
6', 7', 8' gears on driving shafts of pulsators 6, 7, 8
25 Primary driving gear
26 Auxiliary gear
27 Gear on the driving shaft of fourth pulsator

DESCRIPTION OF THE PREFERRED EMBODIMENTS

First Embodiment

What is described by the present embodiment is a washing machine which may realize the objects of the present invention and is specifically described as follows.

A structure and an operation manner of U.S. Pat. No. 6,220,063B1 is shown in FIG. 1, and comprises a control panel 10, a cabinet 13, an outer tub 12 that is suspended in the cabinet 13 with a damping suspension rod 14, an inner tub 11 is rotatably provided in the outer tub 12, the inner tub and pulsators 17 are driven with a motor 15 and a speed reduction system. When used, laundry to be washed is put into the inner tub 11 via a feeding port or case cover 19. Then an appropriate amount of detergent solution (water and detergent) is added.

U.S. Pat. No. 6,220,063B1 discloses that two pulsators obliquely provided are used, the most serious deficiency therein is that rolling is performed only on one rolling face, this also exists in the drum washing machine in the prior art. Another deficiency lies in that, if it is considered to have a more washed laundry to roll, it is necessary to make the pulsators larger. According to this document and a practical washing machine thereof, a diameter of the pulsator is almost consistent with a height of an inner tub, at this time, if less laundry is to be washed it is difficult for the pulsators to clamp washed laundry, and rolling effects is quite poor. If small pulsators are used, the clamping problem occurs with small amounts of laundry and is not resolved, and further a new problem will be yielded. It becomes difficult for a large amount of laundry to be washed and/or to roll.

Figure 6A:
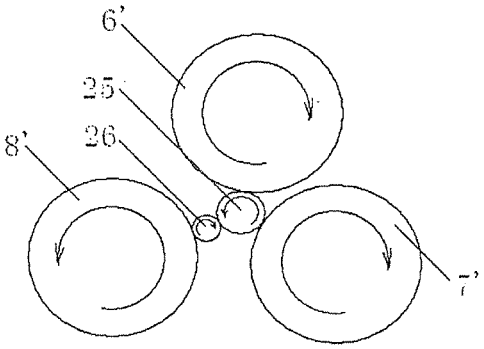
FIG. 6*a* and FIG. 6*b* are schematic diagrams illustrating rotation directions of the driving shafts of pulsators when a primary driving gear of a speed reduced gear train rotates clockwise or counter-clockwise in the embodiments of FIG. 3 and FIG. 4.
Figure 6B:
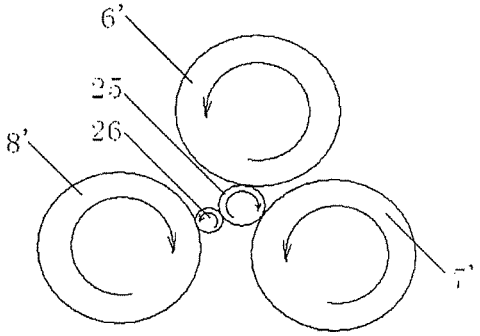

The present embodiment differing from the prior art lies in that, referring to FIG. 3, FIG. 4, FIG. 5, and FIG. 6, a motor 15 drives a primary driving gear 25, when the primary driving gear 25 rotates in an counter-clockwise direction as shown in FIG. 6*a*, gears 6',7' rotate in a clockwise direction, pulsators 6,7 rotate clockwise by means of pulsator shafts thereof, a gear 8' rotates in the counter-clockwise direction by means of an auxiliary gear 26 to drive a pulsator 8 to rotate in the counter-clockwise direction.

Because the pulsators 6, 7, 8 are obliquely provided, laundry is gathered, lifted, projected, and scattered and falls under the driving of the pulsators 6, 8. This process may be one circulation or a plurality of circulations.

Supposing there is one assumed plane 21 between the pulsators 6, 8, the laundry stream 24 moves on the imaginary plane 21.

Research fellows of the present invention particularly points out that, when a pair of rotary pulsators drive laundry to form a circulation of being gathered, lifted, projected, and scattering and falling, an auxiliary force is added at a side position outside of the pair of pulsators. The function of the side auxiliary force is to push washed laundry falling toward the clamped position of washed laundry from the pair of pulsators, regardless of the amount of laundry. It may be effective to drive laundry in a rolling direction 9 of laundry as shown in FIGS. 3*a*,3*b* and better complete the circulation of being gathered, lifted, projected, and scattering and falling.

Referring to FIG. 4*b*, at this time, a main function of the pulsators 6,8 is to gather, lift, and project laundry, and pulsator 7 rotates clockwise. The following is also an explanation on the side auxiliary force of the present invention, that is, the assumed plane 21 basically divides the pulsator 7 into one half close to the pulsator 6 and one half close to the pulsator 8. The one half of the pulsator 7 close to the pulsator 6 and the pulsator 6 identically rotates clockwise, and washed laundry that falls is pushed toward the pulsator 6 in this region. And the other half of pulsator 7 close to pulsator 8 and pulsator 8 together transmits washed laundry to the clamp positions of the pulsators 6,8 along a transmission direction 22 of washed laundry.

On the contrary, referring to FIG. 4*a*, at this time, a main function of the pulsators 7, 8 is to gather, lift, and project washed laundry, and the pulsator 6 rotates counter-clockwise, under a cooperation of pulsator 6 and pulsator 8 washed laundry is transmitted to the clamp position of the pulsators 7, 8.

The "clamp" refers to a process that ribs on the pulsators close to each other and gather and lift washed laundry when the pulsators rotate.

The ribs provided on the pulsators are one in number from a center to an edge. It may be 1~8, preferably may be 4~6.

One important feature of the present invention, is that it realizes a rolling manner that has at least two rolling faces which has never been disclosed in the prior art. This is a significant improvement. The rolling faces take the assumed plane 21 as a reference, an angle between the two rolling faces is larger than 0° and less than 120°, preferably 90~120°, more preferably 120°.

A part of the document in the background technology is an improvement on traditional pulsator washing machines (that is, washed laundry is driven by water stream), that is, a washing water is agitated by the pulsators, laundry is agitated and washed by water streams, but it can not realize a rolling effect similar to the drum washing machine simultaneously because a manner that rotations are in the same direction or not designated is used. It can not realize a multi-direction rolling effect of the present invention. Particularly for CN1170056, with such a provision manner of the pulsators, washed laundry would be immediately clamped between the gears at sides of the pulsators, therefore a normal washing process can not be performed at all.

Therefore, the present invention and the prior art are different in objects, also in resolving means, and in technical solutions as well.

Second Embodiment

Figure 7:
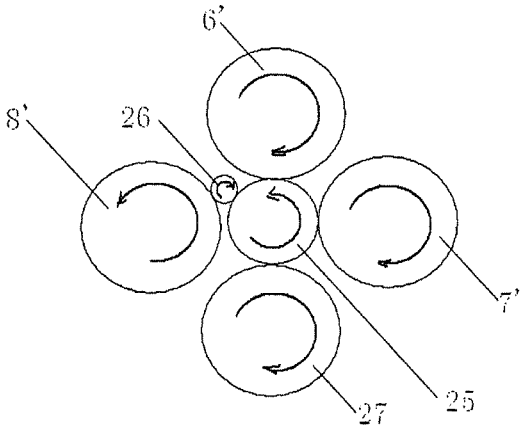
FIG. 7 is an embodiment of the speed reduction gear train of the present invention employing four pulsators.

Referring to FIG. 7, in this Figure, a speed reduced gear train with four driving shafts is provided. Accordingly, each drive shaft connects and drives one pulsator, therefore it has four pulsators; wherein, when one pair of pulsators of these pulsators gathers, lifts, projects washed laundry and have the washed cloth scattered. One of the one pair of pulsators and the other pulsators of these pulsators rotate in the same direction so as to provide a side auxiliary force to washed laundry; in FIG. 7. When a primary driving gear 25 rotates counter-clockwise, the pulsator corresponding to the gear 8' rotates counter-clockwise and the pulsators corresponding to the gears 6', 7', 27 rotate clockwise. At this time the pulsators 8,6 realize a circulation of gathering, lifting, and projecting washed laundry and making washed laundry scatter. Then at this time the pulsators corresponding to the gear 7', 27 mainly act as a provider of the side auxiliary force for as much as possible pushing and/or transmitting washed laundry to a gathering position of the pulsators 8, 6, so as to provide assistance for high efficient lifting.

When the primary driving gear 25 rotates clockwise, the pulsators corresponding to the gears 8', 27 realize a circulation of gathering, lifting, and projecting washed laundry and making washed laundry scatter, at this time, the pulsators corresponding to the gears 6', 7' mainly act as act as a provider of the side auxiliary force for as much as possible pushing and/or transmitting washed laundry to a gathering position of the pulsators corresponding to the gears 8', 27 so as to improve lifting efficiency of washed laundry.

Diameters of the pulsators, heights of the ribs on the pulsators, and rotation speeds of the pulsators determine gathering efficiency, lifting height, and projecting distance of washed laundry; generally speaking, if the diameter of the pulsator is larger, the rib is higher, and the rotation speed is faster, gathering efficiency, lifting height, and projecting distance are improved. However, the rotation speed is faster, wear and tear between the pulsator and washed laundry is yielded faster. In the present invention, the rotation speeds of the pulsators are 10~90 RPM, preferably 30~70 RPM, more preferably 30~45 RPM.

Third Embodiment

The present embodiment is a significant improvement on the technical solution disclosed in U.S. Pat. No. 6,220,063B1. The most serious deficiency on two pulsators obliquely provided in this document is that rolling is performed only on one rolling face, which also exists in the drum washing machine in the prior art. Another deficiency lies in that, if it is considered that a more washed laundry rolls, it is necessary to make the pulsators larger. According to this document and the practical washing machine thereof, a diameter of the pulsator is almost consistent with a height of an inner tub. And at this time, if a small amount of laundry is to be washed it is difficult for the pulsators to clamp washed laundry, rolling effect will be quite poor. If small pulsators are used, a clamping problem on the fewer amount of laundry to be washed is not resolved. A new problem further is yielded, that is, it becomes difficult for a large amount of laundry to be washed to roll.

Figure 8:
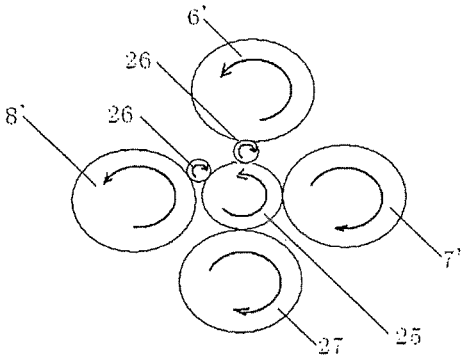
FIG. 8 is another embodiment of the speed reduced gear train of the present invention employing four pulsators.

Under teachings given by the present invention, it may overcome the deficiency in this document with a solution of the present invention as shown in the FIG. 8.

Four pulsator driving gears 6', 7', 8', 27 are used to drive corresponding pulsators respectively as shown in FIG. 8. Which provision manner and technical parameters are the same as those in the previous other technical solutions. When the primary driving shaft 25 rotates counter-clockwise, the pulsators corresponding to the gears 6', 8' rotate counter-clockwise, while the pulsators corresponding to the gears 7', 27 rotate clockwise. Washed laundry takes the pulsators corresponding to the gears 8', 27 as primary transmission pulsators and takes the pulsators corresponding to the gears 6', 7' as primary clamp pulsators to complete a circulation of gathering, lifting, and projecting washed laundry and scatter it. When the primary driving shaft 25 rotates clockwise, the pulsators corresponding to the gears 6', 8' rotate clockwise, while the pulsators corresponding to the gears 7', 27 rotate counter-clockwise, washed laundry takes the pulsators corresponding to the gears 6',7' as primary transmission pulsators and takes the pulsators corresponding to the gear 8', 27 as primary clamp pulsators to complete a circulation of gathering, lifting, and projecting washed laundry and making washed laundry scatter.

Fourth Embodiment

In a washing manner described in the present embodiment, there at least are two rolling faces for washed laundry. The rolling faces are formed by pulsators, wherein one of the rolling faces for washed laundry is formed by two pulsators which are adjacent and are obliquely provided so as to complete a process of gathering, lifting, and projecting washed laundry and making washed laundry scattering and falling, referring to FIG. 5. Another of the rolling faces for washed laundry is formed by another group of two pulsators which are adjacent and are obliquely provided so as to complete a process of gathering, lifting, and projecting washed laundry and making washed laundry scattering and falling. An angle between the two rolling faces is larger than zero degrees.

Certainly, it may form more than two rolling faces, preferably 2~8 rolling faces, more preferably 2~4 rolling faces, but most preferably two rolling faces.

Any one of the rolling faces is formed by rotations of two pulsators.

A plurality of rolling faces are formed by different pulsators. Two pulsators is one group. One pulsator of two or more groups of pulsators may be shared or may be not shared.

The rolling face forms one assumed plane 21 in a rolling direction; an angle between the two assumed planes formed by the two rolling faces is 20~160 degrees, preferably 80~140 degrees, and most preferably 120 degrees.

More than one rolling is continuously performed on any one of the rolling faces and then it is switched to another rolling face so as to continuously perform more than one rolling on another rolling face. This process is repeatedly circulated until washing is completed.

The number of rolling on different rolling faces is identical or different.

Fifth Embodiment

What is described by the present embodiment is a provision manner of an inner tub. In the drum washing machine in the prior art, there is a certain amount of water between an inner tub and an outer tub. The water is removed from holes in a side wall of the inner tub. So does the pulsator washing machine.

In the prior art, such a technical solution is also disclosed, that is, an inner tub does not have a hole from which water is removed. Or the lower portion of the inner tub does not have a hole from which water is removed. If a washing method of the traditional pulsator washing machine is employed, the amount of water must reach a level that washed laundry is able to basically float, which is an important precondition. Therefore, a lower part of the inner tub does not have a hole, which means that a water level in the inner tub can not exceed a position from which a hole provided from a middle and upper portion of the inner tub from which water is removed. When more laundry is washed, obviously, it can not smoothly complete a washing process.

A technical solution in which the whole inner tub does not have a hole must employ a centrifugal manner to remove water in the inner tub, which may result in an increment of energy consumption, or may not completely remove the washing water.

However, combination of the prior art in which a part is provided with a hole from which water removed with the technical solution of the present invention may attain unexpected excellent effects. As previously described, the pulsator-type rolling method for the washed laundry in the present invention can perform rolling even in a case that there is no water. An optimum washing state will be performed in a state that washed laundry contains saturated water. Therefore when the present invention is combined, it may attain an effect that water is saved more than that in the drum washing machine.

First Experimental Example

The present experimental example performs an experiment on a washing machine structure in the prior art. For example, technical solutions disclosed in CN200610149183 and CN200610164325, according to a manner of the pulsator washing machine, the prototype in the experiment is formed by modifying a pulsator washing machine with a capacity of 5 Kg available from the market. In order to reduce complexities in the experiments, a manner with three pulsators is selected and each pulsator has six ribs uniformly provided.

According to indication from the specification, if washed laundry is 1 Kg, 3 Kg, 5 Kg in size, a lower water level, a middle water level, and a higher water level are selected respectively. Such a configuration is common knowledge in the pulsator washing machine in the prior art. And a basic principle of the pulsator washing machines lies in that a water level should be above washed laundry so that water stream can drive washed laundry when the pulsators agitate the water.

It can be seen from results that, according to the traditional manner of the pulsator washing machine that rolling effects of washed laundry floating in water is obviously not good as that before modification.

As disclosure on the second page of the description of CN200610149183, rolling effects, under visual test in a case that the water level is lowered to one third of the pulsator and rotation is performed clockwise or counter-clockwise at the same time, is not good as that in the pulsator washing machine in the prior art yet.

With reference to disclosure of the description of CN2006101 64325, although a phenomenon occurs as disclosed on the third page of the description of this document, i.e. "water stream generated rolls, agitates, washed laundry", however, a washing effect thereof is not good as that in the prior art.

As now, for a routine process of the experiment, the person skilled in the art should abandon further experiments.

Research fellows of the present invention unexpectedly found a phenomenon during experiments. The modified washing machine starts and the pulsators begin to rotate. When the pulsators assume a state that two pulsators rotate in the same direction and one pulsator rotates in a converse direction and a quite small amount of water is supplied at the same time, washed laundry has an obvious rolling on one pair of pulsators of the three pulsators. When rotation direction of the motor is changed conversely, it found that washed laundry has an obvious rolling on another pair of pulsators. and these rollings have a certain degree. This phenomenon makes the research fellows of the present invention associated U.S. Pat. No. 6,220,063 B1 as set forth in the background technology, hereinbefore, the research fellows of the present invention researched this washing machine, because a practical product thereof rotates in a single direction, washed laundry assumes a balled "Rugby shape", cleaning rate is also lower, which is also a reason why this product can not be widely popular in the market.

This unexpected find made the research fellow of the present invention conceive that, in several decades, people skilled in the washing machine field always wants to combine advantages of and get rid of deficiencies of the pulsator washing machine and the drum washing machine, U.S. Pat. No. 6,220,063 B1 teaches us that, if the teaching is combined and at least two rolling directions are further formed, from which a technical solution resulted should be one unexpected and never previously existed.

Figure 9:
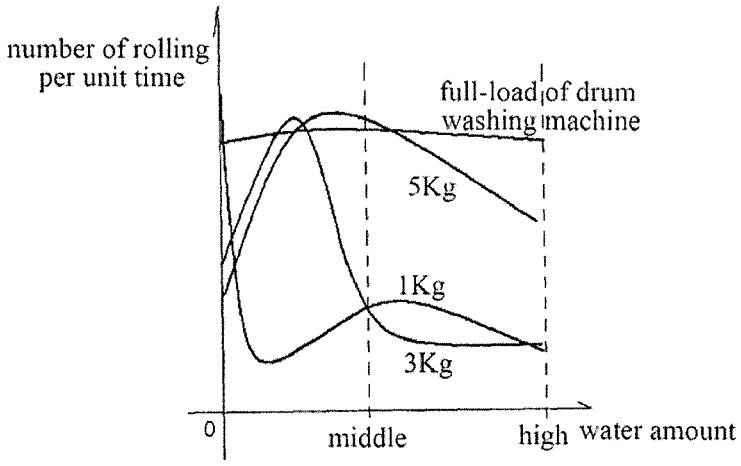
FIG. 9 is a graph showing a relationship among weight of laundry, water consumption amount, and the number of rolling in experimental examples of the present invention.

Based on the above concept, the previous modified prototype is used. The water level is selected as none, middle, and high, washed laundry (using a standard cloth) is selected as 1 Kg, 3 Kg, 5 Kg, referring to FIG. 9. What has been found from the experiment and curves in this figure are described as follows:

In the prototype of the present experimental example, with respect to washed laundry of 5 Kg, the number of rolling per unit time for washed laundry increases as the amount of water increases. Which assumes a sine curve; the number of rolling per unit time initially is lowest when there almost is no water. This is because there is too much laundry to be washed. Rolling actions are transferred to an upper layer of washed laundry with difficulty. As the amount of water increases, the amount of water contained in washed laundry gradually increases, frictional force among washed laundry increases, and driving forces of the pulsators functions. When the amount of water exceeds a certain degree, a part of a gravity of washed laundry is cancelled out by buoyance. Thus the driving force of the ribs of the pulsators applied to washed laundry and a force applied among laundry begin to reduce and the number of rolling gradually lowers.

In the prototype of the present experimental example, with respect to washed laundry of 3 Kg, the number of rolling per unit time for washed laundry increases as the amount of water increases. Which assumes a more complex curve; the number of rolling per unit time initially is higher than that with respect to washed laundry of 5 Kg when there is almost no water. This is because that washed laundry is relative few, rolling actions are relatively easily transferred to an upper layer of washed laundry. As the amount of water increases, the amount of water contained in washed laundry gradually increases, a frictional force among washed laundry increases, a driving force of the pulsators functions, because the amount of washed laundry is relative small, the maximum number of rolling is shifted to an earlier time. When the amount of water continuously increases to a maximum value the washed laundry almost floats in water. The number of rolling gradually lowers to quite a low degree.

In the prototype of the present experimental example, with respect to washed laundry of 1 Kg, the number of rolling per unit time for washed laundry increases as the amount of water increases, which assumes a most complex curve; the number of rolling per unit time initially is best when there almost is no water. This is because that washed laundry is quite small. Rolling actions formed by the pulsators is almost immediate and completely transferred to all the washed laundry. As the amount of water increases, it is easy to attain a circumstance making washed laundry float. The number of rolling of washed laundry lowers sharply. When the amount of water continuously increases, the pulsators agitate the water stream, floating washed laundry rolls with regular water stream, conversely, the number of rolling increases. When the amount of water continuously increases to a maximum value, an effect of the rolling force of the pulsators almost is lost. The number of rolling of washed laundry in water gradually lowers to a quite low degree.

As can be seen from the above experiments, even though the inventor unexpectedly found that two rolling directions can be realized in the prototype, a complex relationship is formed between a water amount and a weight of washed laundry. If the factors of rotation speeds of the pulsators, shapes and heights of the ribs on the pulsators, a diameter ratio of an inner tub, and the like, are further taken into account, its complexity can not be imagined. From preliminary selection taken from the previous prototype and experiments and in combination with parameters obtained from FIG. 9, with respect to the number of rolling of laundry, it can be judged that a case that washed laundry is from a few to a maximum amount are comprehensively taken into account. In a condition that when the saturated amount of water is contained in washed laundry, the number of rolling is in a better range.

By a large quantity of experiments, during normal washing, the amount of washing water is preferably as 1.2~6.5 times of the saturated amount of water, preferably 1.4~4 times.

When foam stream surface washing in the prior art is used (referring to a previous relevant patent application of Haier Company), the washing water amount is preferably 0.8~1.4 times of the saturated amount of water, but preferably 1~1.2 times.

During rinsing, the washing water amount is preferably 2.2~7.5 times of the saturated amount of water, preferably 2.4~4.5 times.

In the present invention, the standard cloth is a cloth specified according to appendix A of Chinese GB/T 4288-2008.

The saturated amount of water is referred as follows. A certain amount of cloth specified according to the appendix A of Chinese GB/T 4288-2008 is used and immerged into water and rolled up-down three time by hand. The time that the cloth is immerged in water is five minutes. All of the cloth is taken out and uniformly disposed on a flat stainless steel screen mesh, which is suspended and has screen number of 10~20 for five minutes so as to make the surplus amount of water stream out (circumstance condition is 20±10 and humidity is 25±10%). At this time the amount of water absorbed in the cloth is the saturated amount of water of the specified amount of the cloth.

When the drum washing machine in the prior art has or does not have a load, the number of rolling of laundry per unit time changes relatively little as the amount of water changes. However, in the rolling method of the present invention, the number of rolling of laundry is relatively more affected by the amount of water. This is possibly because the rolling manner of the present invention is almost not affected by a centrifugal force characterized in the rotation of the drum.

Second Experimental Example

The present experimental example attempts to research the changes of the number of rolling of washed laundry that contains water saturation in the amount of water with the change of the number of ribs on the pulsator under a condition that the amount of laundry (using a standard cloth) is constant. The experiment further includes experimental results under three amounts of washed laundry. And the experiment employs two different rotation speeds of the pulsators under non-load which intends to obtain possible regulations. The rib is referred to as a protrusion formed from a center of the pulsator to an edge of the pulsator. Which is similar to a rib on a pulsator in the prior art. The number of ribs is referred to as the number of ribs fixed on the pulsator. A definition of washed laundry is as previous described. The specific experimental results are as follows.

| The number of ribs (rotating speed without load is 40 RPM) | Washed laundry of 1 Kg | Washed laundry of 2 Kg | Washed laundry of 3 Kg |
|---|---|---|---|
| one rib | 19 times/min | 22 times/min | 20 times/min |
| two ribs | 22 times/min | 23 times/min | 21 times/min |
| three ribs | 38 times/min | 29 times/min | 27 times/min |
| four ribs | 47 times/min | 38 times/min | 33 times/min |
| five ribs | 48 times/min | 41 times/min | 40 times/min |
| six ribs | 47 times/min | 42 times/min | 41 times/min |
| seven ribs | 49 times/min | 41 times/min | 39 times/min |
| eight ribs | 45 times/min | 41 times/min | 41 times/min |

| The number of ribs (rotating speed without load is 30 RPM) | Washed laundry of 1 Kg | Washed laundry of 2 Kg | Washed laundry of 3 Kg |
|---|---|---|---|
| one rib | 22 times/min | 15 times/min | 12 times/min |
| two ribs | 25 times/min | 18 times/min | 15 times/min |
| three ribs | 27 times/min | 20 times/min | 15 times/min |
| four ribs | 33 times/min | 24 times/min | 17 times/min |
| five ribs | 42 times/min | 27 times/min | 19 times/min |
| six ribs | 48 times/min | 29 times/min | 20 times/min |
| seven ribs | 48 times/min | 28 times/min | 19 times/min |
| eight ribs | 47 times/min | 29 times/min | 20 times/min |

As can be seen from the above experimental data, the number of rolling of laundry tends to increase as the number of ribs increases; when the number of ribs reaches a certain amount, increment of the number of rolling tends to be flat and slow. After all the above experimental results are comprehensively considered, the number of ribs is preferably 3~7, and more preferably 4~6.

The present experimental example, the number of rolling is calculated as follows: Designating the amount of standard cloth, using three clothes respectively with different colors (for example, red, blue, green), each with a size of 5*5 cm (it is enough when quality is close to the standard cloth), and stitching one side of each color cloth respectively with one side of respective one of the three standard cloth. Then uniformly dispersing in all the standard cloths, after rolling (keep rolling on a pair of pulsators) for 1~2 minutes, observing the times of each color cloth appearing in a predetermined time. Summing the number of each color cloth appearing in a predetermined time, and then dividing the summation by three. A result from which is the number of rollings in the present invention.

What is claimed is:

1. A method for driving laundry to roll in an upright tub with plurality of pulsators, comprising: making laundry alternately but not simultaneously form at least two rolling faces in the upright tub, the at least two rolling faces having a certain angle therebetween, the laundry being rolled more than one time on one of the rolling face and then the laundry being rolled more than one time on another rolling face; and providing a side auxiliary force during the rolling processes with at least one of the plurality of pulsators having at least one rib;

wherein one of the at least two rolling faces being formed by rotating and driving laundry by a pair of pulsators which are adjacent and obliquely provided; the at least one rib on the pulsators lifts laundry and makes laundry fall in a similar continuous laundry stream manner and then again lift laundry; this process is repeated at least three times; another rolling face of the at least two rolling faces is alternately and not simultaneously formed by rotating and driving laundry by another pair of pulsators which are adjacent and obliquely provided; the at least one rib on the pulsators lifts laundry and makes laundry fall in a similar continuous laundry stream manner and then again lift laundry; this process is repeated at least three times; the number of rolling of the laundry on the different rolling faces may be same or may not be same; the rolling process is repeated for a predetermined number of times.

2. The method according to claim 1, wherein the angle between the at least two rolling faces is 60~120 degree; the number of the pulsators is 3~6; and the number of the ribs on each of the pulsators is 3~8.

3. The method according to claim 2, wherein the number of the pulsators is 3~4; and the number of the ribs on each of the pulsators is 4~6.

4. The method according to claim 1, wherein one of the pulsators in the one pair of pulsators or the another pair of pulsators is shared; the ribs on a pair of adjacent rotary pulsators drive laundry gathered, lifted and then laundry is projected, scattered and fallen due to inertia and gravity.

5. The method according to claim 1, wherein the rotation speed of the pulsators is 30~70 RPM; an axis of a central driving shaft of the pulsators is intersected with a central axis of an inner tub; an acute angle part of an angle between the two intersected axes is 10~60 degree.

6. An upright tub-type washing machine which performs the method according to claim 1 in a washing and rinsing process, the washing machine comprises a control panel, a cabinet, an outer tub suspended in the cabinet by a damping suspension rod, and an inner tub rotatably provided in the outer tub; the inner tub and the pulsators are driven with a motor and a speed reduction system; wherein the amount of water to be used is 0.8~7.5 times of the saturated amount of water.

7. The upright tub-type washing machine according to claim 6, wherein the amount of water to be used is 2.4~4.5 times of the saturated amount of water.

8. The upright tub-type washing machine according to claim 6, wherein the amount of water to be used is 1.2~4 times of the saturated amount of water.

9. The upright tub-type washing machine according to claim 6, wherein the amount of water to be used is 0.8~1.2 times of the saturated amount of water.

* * * * *